US006569068B1

(12) United States Patent
Cox

(10) Patent No.: US 6,569,068 B1
(45) Date of Patent: May 27, 2003

(54) HANDHELD WHIRLING AND BALANCING DEVICE

(76) Inventor: Timothy T. Cox, 937 N. Lawrence St., Philadelphia, PA (US) 19123

( * ) Notice: Subject to any disclaimer, the term of this patent is extended or adjusted under 35 U.S.C. 154(b) by 0 days.

(21) Appl. No.: 09/678,894

(22) Filed: Oct. 5, 2000

(51) Int. Cl.[7] ..... A63B 1/00

(52) U.S. Cl. ..... 482/148; 482/44; 446/325; D21/399

(58) Field of Search ..... 482/44–50, 148; D21/398–400, 455, 684, 811, 166, 590, 635, 468; 446/325, 385, 253, 236–241, 266, 242, 246, 255, 265, 322, 323; 67/22; 273/329, 320, 330; 601/40

(56) References Cited

U.S. PATENT DOCUMENTS 1,614,454 A * 1/1927 Cazes ..... 446/323
1,711,150 A * 4/1929 Likes ..... 446/322
3,679,204 A * 7/1972 Busby ..... 272/81
3,701,215 A * 10/1972 Marason et al. ..... 446/322
4,300,771 A * 11/1981 Lori ..... 273/329
4,391,064 A * 7/1983 Lakin et al. ..... 446/227
D312,852 S * 12/1990 Wiseman et al. ..... D21/590
5,240,256 A * 8/1993 Hartman ..... 273/320

* cited by examiner

*Primary Examiner*—Nicholas D. Lucchesi
*Assistant Examiner*—Tam Nguyen

(57) ABSTRACT

Grasping the device by its handles, and applying motive force through wrist and forearm motion, the pair of arms and the final component of the device may be made to simultaneously or individually whirl about their axes of rotation in an infinite variety of sequences and an assortment of styles. Holding the device by either handle, or by both of its handles, and applying concentration and steadiness of hand, there are several balancing configurations which may be achieved. Setting the device on a surface, there are additional balancing configurations which may be attained.

1 Claim, 2 Drawing Sheets

HANDHELD WHIRLING AND BALANCING DEVICE

CROSS-REFERENCES TO RELATED APPLICATIONS

This application is a revision of one filed Oct. 5, 2000, application Ser. No. 09/678,894, which was returned with objections and a transmittal letter dated Mar. 29, 2002. The invention, which is the subject of this application, employs the same twin-axis rotation concept demonstrated in my patent, "Folding, Sliding, Integrated Sports Goal", U.S. Pat. No. 5,655,774, issued Aug. 12, 1997.

STATEMENT REGARDING FEDERALLY SPONSORED RESEARCH OR DEVELOPMENT

Not Applicable.

BACKGROUND OF THE INVENTION

The invention relates to simple handheld devices incorporating handles connected to an assembly and involves the generation of motion to movable components attached to the assembly through the application of bodily motion through the handles. Several examples will illustrate. The first two examples demonstrate devices with handles interconnected by a rod. U.S. Pat. No. 4,300,771 to Lori (1981) discloses a device with handles interconnected by a rod around which a ball and string rotate. A key hole is provided, with the object of the device being to rotate the ball and string, through wrist and arm motion applied through the handles, such that the ball passes through the key hole. U.S. Pat. No. 5,240,256 to Hartman (1993) discloses a device in which rotating handles are interconnected by a rod which is incorporated into a larger frame. Force applied to the handles causes the frame to rotate. A ball and string attached to the frame is caused to move in relation to the frame. Such ball movement has specific objectives such as entering the ball into a receptacle or rolling it along a track. The final example, U.S. Pat. No. 3,679,204 to Busby (1972), demonstrates two handles on either side of a single shaft, and a third handle positioned at right angles to that shaft. Two arms attached to the shaft are interconnected by a rod around which a final assembly may be made to rotate. This final assembly is weighted and the bodily motion applied to it through the handles is stated to be an exercise to various muscles within the human frame.

BRIEF SUMMARY OF THE INVENTION

Unlike the examples cited, my invention contains two distinct, yet interdependent, members to which parallel, 360 degree rotation may be transmitted: the pair of arms and the final component. Two spaced-apart handles are interconnected by a rod. This rod, loosely passing through two spaced-apart arms, serves as an axis of rotation for these two arms. The arms themselves are interconnected by a second rod. This second rod, loosely passing through a final component, serves as an axis of rotation for this final component.

The handles, arms and final component are each somewhat rigid in structure, giving them the ability to stand erect in unison. Additionally, the handles may be held horizontal, sustaining the other members in an erect position. There are a number of other balanced arrangements. Thus, unlike the other inventions cited, there are a number of challenging balancing configurations which may be achieved when the tendency to topple at the two axes of rotation is overcome by steady hand.

G. DETAILED DESCRIPTION OF THE INVENTION

Figure 1:
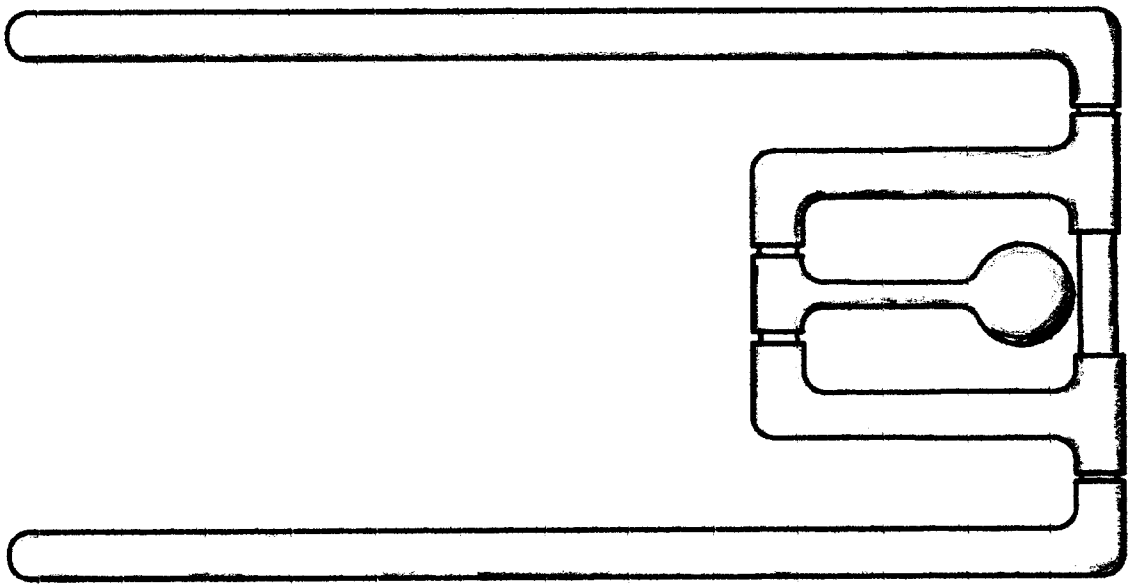
FIG. 1 shows the device in its most compact configuration.
Figure 2:
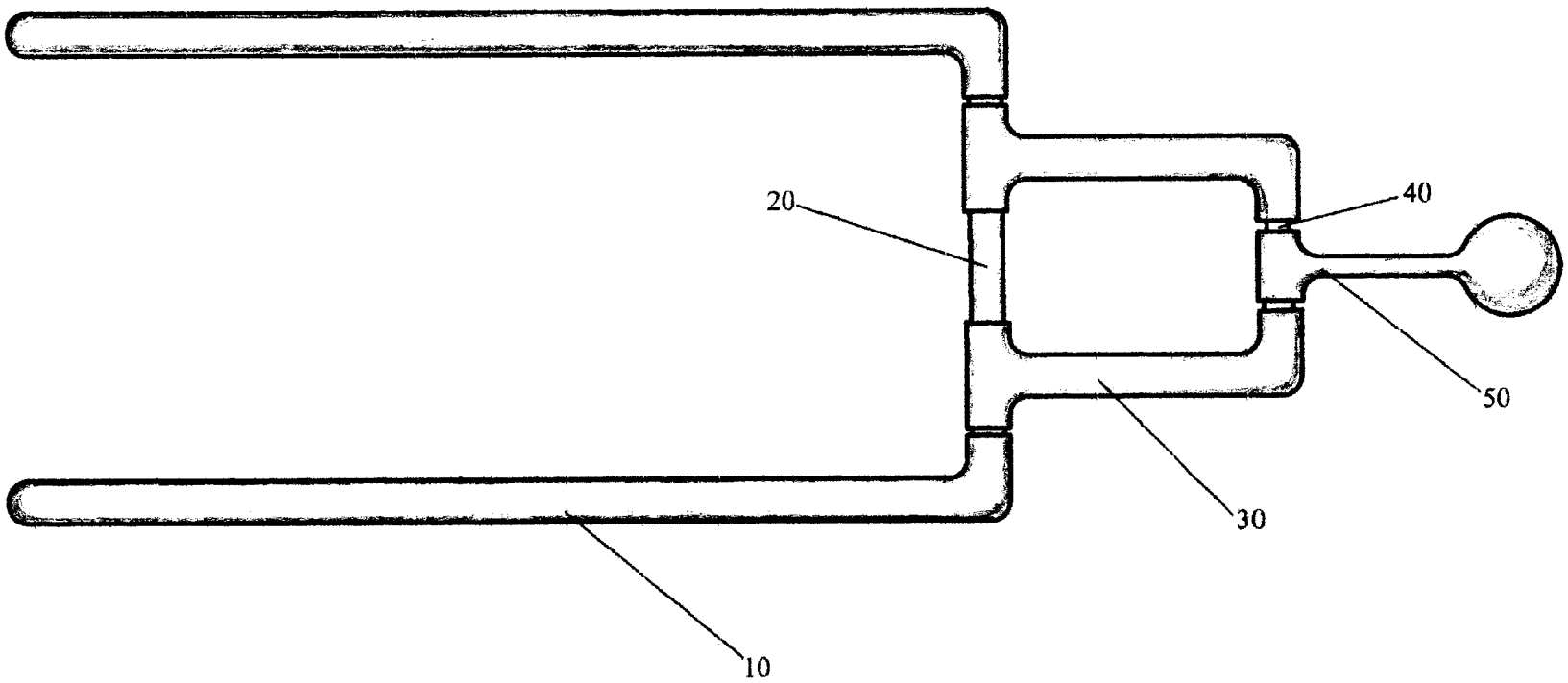
FIG. 2 shows the device in its most extended configuration.

Referring to FIG. 2 of the drawings, observe handles 10 interconnected by rod 20 which passes through one end of arms 30. See the arms interconnected at their opposite ends by a second rod 40 which passes through an end of the final component 50.

My invention provides two distinct, yet interdependent members to which 360 degree rotation may be applied through manipulation of the handles 10—the pair of arms 30 and the final component 50. Such motion may involve: rotating arms with the final component stationary in relation to the arms; stationary arms in relation to the handles and a rotating final component; and both the arms and component rotating simultaneously in relation to the handles and to one another. In all cases, the rotating elements may be empowered to rotate in either of two possible directions.

It should be pointed out that the final component as represented by the drawings is merely symbolic. The final component may be in the shape of a monkey, a trapeze performer or might have a rubber ball on its end to soften any possible blow while the device is whirled by an inexperienced child with short arms.

There are some particularly challenging feats which may be performed while holding the handles of the device in a fairly horizontal configuration and applying motive force: maintaining the arms in a stationary downward position while the final component is made to rotate in either of its possible directions; and causing the rotation of the arms and the final component simultaneously but in opposite directions. Referring to the latter feat, in one case the arms may rotate forward while the final component rotates backwards and in another case, the arms may rotate backwards while the final component rotates forward. However, it is unnecessary to perform or attempt to perform any of these particular whirling feats to thoroughly enjoy the whirling, which is virtually unlimited in possible sequences.

There are a number of features of the device which deserve to be pointed out:

While the operation of other similar devices (see SECTION D) is generally directed towards a specific objective such as guiding a ball through a keyhole, positioning a ball into a designated spot or promoting muscular exercise, the whirling of the device which is the subject of this application may be enjoyed with no particular objective in mind. The simple feel and grace of motion brings excitement to those doing the whirling. The ambiguity regarding the purpose of the activity provokes wonder and joy in those observing the whirling, and invariably elicits smiles upon curious faces.

The device may be whirled while walking with one's eyes closed, with the simple gravitational and centrifugal feel providing sensorial direction for injecting additional wrist/forearm impulses. The simplicity and feel of the motion can be grasped even by small children within a very short time frame. Virtually anyone can quickly become adept whirling this device. The feet of the motion coupled with the visual image of the whirling makes the device an ideal tool for the treatment of autistic children. Because the play of the device is something that involves engaging physical activity, coupled with the highly stimulating visual sights produced, the device provides an excellent diversion for a child fussing in a doctor's office or the adult who is nervous or craving a cigarette.

A feature of the device which has proven extremely practical is its hand-free portability. Bringing the handles over one's shoulders from behind, with one handle on either side of the neck, and the arms and final component hanging down the back, one can walk, sit or perform most ordinary activities with the device safely and comfortably accompanying.

The device may be used for "exercise" in its fullest meaning from a collegiate dictionary: "Activity that requires physical or mental exertion, especially when performed to develop or maintain fitness." The infinite variety of possible sequences and styles of motion possible in the whirling of the device means that the activity can be a challenge not only to the body but also to the mind. There is the prospect for a high degree of concentration, especially when attempting to perform some of the whirling feats already mentioned. The field is virtually unlimited for new motions, with some such new possible motions being over-one's-head or through-one's-legs whirling.

Another exciting aspect of the device is that a number of people, with an equal number of devices in hand, can coordinate their motion and perform highly alluring movements in synchronicity. This can be coupled with the addition of rhythmic music, with the devices whirling to the beat.

The device may be whirled while walking, sitting or standing still. It may be whirled inside or outside, and the silence of its operation is a great asset when calming a crying child in a crowded room. It provided a self-contained activity, in that it requires no field, goal structure, netting or rules of play.

A most popular balancing challenge has become known as "Doing Midnight". This activity involves holding the handles horizontal with one's hands crossed and with the arms and final component of the device hanging straight down at "six o'clock". Slowly and carefully uncrossing one's hands, one attempts to rotate the device so that the arms and final component remain in line without toppling and reach the upward vertical position of "midnight". "Midnight" must be held stationary and is not a fleeting achievement. From the "midnight" position, the challenges become even more dramatic. Two that test the most experienced players are: "Midnight 360" which requires that one maintain "midnight" while turning in a full circle; and "10 Step Midnight" which requires a 10-step walk while maintaining "midnight".

Another balancing challenge involves holding the device by a single handle, and positioning the device so that the handles, arms and final component are all hanging down in a straight line, in a configuration represented by FIG. 2 of the drawings. The whole assembly is then slowly rotated and raised until it becomes vertical, with the final component now positioned at the top, while maintaining alignment.

For small children, balancing challenges can involve the placement of the device on a flat surface, completely extended as in FIG. 2. The handles can then be brought to a vertical position and balanced. The same can be done for the final component and arms together in a vertical alignment. Likewise, the arms may be brought vertical while the final component remains in a downward position. Finally, the handles and final component may be balanced in a vertical position while the arms remain horizontal.

Having described my invention, I claim:

1. An exercise and recreation device comprising:

a first elongated cylindrical rod having a first and second end;

a first elongated handle having a first end and a second end wherein the second end is attached at a right angle to the first end of said first rod, a second elongated handle, equal in length to the first handle, having a first end and a second end wherein the second end is attached at a right angle to the second end of said first rod;

a second elongated cylindrical rod having a first and second end;

a first arm having a first end rotatably attached to said first rod between said first and second handles and a second end attached at a right angle to the first end of said second rod, a second arm, equal in length to the first arm, having a first end rotatably attached to said first rod between said first and second handles and a second end attached at a right angle to the second end of said second rod; and a final component rotatably attached to said second rod between said first and second arms;

wherein the final component is shorter than the first and second arms which are shorter than the handles such that the final component and the first and second arms may rotate a full 360 degrees on said second rod and first rod respectively.

* * * * *

UNITED STATES PATENT AND TRADEMARK OFFICE

CERTIFICATE OF CORRECTION

PATENT NO. : 6,569,068 B1
DATED : May 27, 2003
INVENTOR(S) : Timothy T. Cox

It is certified that error appears in the above-identified patent and that said Letters Patent is hereby corrected as shown below:

Column 2,
Line 65, reads: "The feet of the motion coupled with the visual image of the whirling...". and should read: -- The feel of the motion ... --.

Signed and Sealed this

Ninth Day of September, 2003

JAMES E. ROGAN
*Director of the United States Patent and Trademark Office*